US008168064B2

(12) United States Patent
Peters, Jr. et al.

(10) Patent No.: US 8,168,064 B2
(45) **Date of Patent: *May 1, 2012**

(54) STEP FLANGE CATCH BASIN ADAPTOR AND METHOD OF USING

(75) Inventors: John Peters, Jr., Manorville, NY (US); John E. Markee, Selden, NY (US)

(73) Assignee: Fabco Industries, Inc., Jericho, NY (US)

( * ) Notice: Subject to any disclaimer, the term of this patent is extended or adjusted under 35 U.S.C. 154(b) by 1402 days.

This patent is subject to a terminal disclaimer.

(21) Appl. No.: 11/371,529

(22) Filed: Mar. 9, 2006

(65) Prior Publication Data

US 2006/0267336 A1 Nov. 30, 2006

Related U.S. Application Data

(60) Provisional application No. 60/659,820, filed on Mar. 9, 2005.

(51) Int. Cl.
*E03F 5/06* (2006.01)

(52) U.S. Cl. ... 210/163; 210/232; 210/282; 210/170.03; 210/474; 210/477

(58) Field of Classification Search ..... None
See application file for complete search history.

(56) References Cited

U.S. PATENT DOCUMENTS 1,041,887 A * 10/1912 Schodde ..... 210/163
4,203,686 A * 5/1980 Bowman ..... 404/25
4,487,690 A * 12/1984 Logsdon ..... 210/163
4,923,330 A 5/1990 DeTommaso
5,032,264 A * 7/1991 Geiger ..... 210/163
5,417,855 A * 5/1995 Gershenson ..... 210/315
5,622,630 A 4/1997 Romano
5,707,527 A 1/1998 Knutson et al.
5,744,048 A 4/1998 Stetler
5,954,952 A 9/1999 Strawser, Sr.
6,027,639 A 2/2000 Lenhart, Jr. et al.
6,059,964 A 5/2000 Strawser, Sr.
6,080,307 A 6/2000 Morris et al.
6,099,723 A 8/2000 Morris et al.
6,106,707 A 8/2000 Morris et al.
6,231,758 B1 5/2001 Morris et al.
6,241,889 B1 6/2001 Haley, III
6,274,036 B1 * 8/2001 Ellis ..... 210/164
6,277,274 B1 8/2001 Coffman
6,350,374 B1 2/2002 Stever et al.
6,368,499 B1 4/2002 Sharpless
6,447,686 B1 9/2002 Choi et al.
6,537,448 B2 * 3/2003 Houk ..... 210/164
(Continued)

*Primary Examiner* — Robert James Popovics
(74) *Attorney, Agent, or Firm* — Knoble Yoshida & Dunleavy, LLC

(57) ABSTRACT

A method of mounting a grate adapter unit beneath a stormwater collection grate includes steps of providing a grate adapter unit having a plurality of outwardly extending mounting flanges, each mounting flange being adapted to fit a different size commercially common stormwater collection grate. The grate adapter unit is trimmed, either at the factory, at the contractor's facilities or at the installation site, at the desired location to select a desired one of the mounting flanges that is appropriate for the collection grate to which the grate adapter is being fit. The grate adapter unit is then mounted beneath the stormwater collection grate using the selected mounting flange. A stormwater remediation unit may be pre-mounted to a lower end of the grate adapter unit or mounted to the lower end after installation.

20 Claims, 5 Drawing Sheets

U.S. PATENT DOCUMENTS

| | | | | |
|---|---|---|---|---|
| 6,789,396 | B2 | 9/2004 | Olin-Nunez et al. | |
| 6,997,636 | B2 * | 2/2006 | Tremouilhac | 404/5 |
| 7,001,507 | B2 * | 2/2006 | Orozco et al. | 210/164 |
| 7,025,213 | B2 * | 4/2006 | Chen | 210/474 |
| 7,040,838 | B2 * | 5/2006 | Allard et al. | 405/36 |
| 7,094,338 | B2 * | 8/2006 | Morris et al. | 210/163 |
| 7,108,783 | B2 * | 9/2006 | Glazik | 210/163 |
| 7,128,832 | B2 * | 10/2006 | Wade | 210/155 |
| 8,012,346 | B2 * | 9/2011 | Peters et al. | 210/170.03 |
| 2002/0113007 | A1 * | 8/2002 | Chiodo | 210/497.01 |
| 2003/0034286 | A1 | 2/2003 | Butler | |
| 2004/0232057 | A1 * | 11/2004 | Orozco et al. | 210/86 |
| 2004/0238438 | A1 * | 12/2004 | Chen | 210/474 |
| 2005/0103694 | A1 * | 5/2005 | Rost et al. | 210/164 |
| 2005/0183997 | A1 * | 8/2005 | Happel et al. | 210/163 |
| 2005/0235408 | A1 * | 10/2005 | Stetson | 4/508 |
| 2006/0102543 | A1 * | 5/2006 | Peters et al. | 210/170 |
| 2006/0124519 | A1 * | 6/2006 | Glazik | 210/163 |
| 2006/0267336 | A1 * | 11/2006 | Peters et al. | 285/85 |
| 2008/0023382 | A1 * | 1/2008 | Longo et al. | 210/164 |
| 2008/0083676 | A1 * | 4/2008 | DePaul | 210/774 |
| 2008/0189926 | A1 * | 8/2008 | Luxton | 29/428 |
| 2010/0325862 | A1 * | 12/2010 | Peters et al. | 29/428 |

* cited by examiner

STEP FLANGE CATCH BASIN ADAPTOR AND METHOD OF USING

This is a non-provisional claiming priority under 35 U.S.C. §119(e) to provisional application Ser. No. 60/659,820, filed on Mar. 9, 2005.

BACKGROUND OF THE INVENTION

1. Field of the Invention

This invention relates broadly to systems and processes for cleansing storm water, such as that which is created by storm runoff from streets, highways, parking lots and other paved surfaces into drainage systems in major urban areas. More specifically, the invention relates to an improved system and method for mounting components to the underside of a stormwater grate, such a those that are commonly located in large asphalt parking lots of shopping malls, train stations and similar facilities.

2. Description of the Related Technology

Storm water that is created by storm runoff in heavily developed areas is typically channeled into storm drainage systems that eventually drain into nearby streams, creeks, rivers or other bodies of water. Unfortunately, paved surfaces that bear automobile traffic typically become coated with significant pollutants such as heavy metals and volatile organic compounds, both under normal traffic conditions and in particular when motor vehicle accidents occur. When normal rain or snowfall occurs, these pollutants tend to be swept away with the runoff storm water and eventually lead to contamination of the bodies of water that eventually receive them. Such contamination has become a significant environmental issue in many areas. In addition, a significant amount of debris such as bottles and cans tends to be swept away by storm water runoff.

Systems exist for filtering storm water runoff that are effective in removing debris from storm water and in removing certain other pollutants, such as hydrocarbons. For example, U.S. Pat. No. 6,080,307 discloses a storm drain insert that contains one basket for the collection of debris as well as a canister that contains a hydrophobic, compliant, oil-absorbent copolymer material that is said to be effective in removing oil from the storm water.

Fabco Industries, Inc. of Bohemia, N.Y. has been a pioneer in developing systems for removing contaminants such as heavy metals from storm water in situ within a storm water drainage system. One type of Fabco treatment system 10 that is depicted in FIG. 1 is designed for stormwater facilities that have a storm grate 12 that is set within a frame rim 14, such a those that are commonly located in large asphalt parking lots of shopping malls, train stations and similar facilities. This system 10 is constructed and arranged to process inflowing storm water 16, as is shown diagrammatically in FIG. 1, and so that during heavy storm water flow conditions any excess flow 18 of storm water that is incapable of being processed by the system 10 will be permitted to flow through an overflow or bypass opening 40 into the storm water drainage system. Storm water 20 that is processed by the system 10 will also flow into the storm water drainage system through a pair of exit openings 38, as will also be described in greater detail below.

As is further shown in FIG. 1, a process chamber 21 is defined within a receptacle 22 that has a bottom surface 24 and a plurality of side surfaces 26. Receptacle 22 is integral with a metallic tray 30 that is mounted so as to depend downwardly from the storm grate 12 and the connected frame rim 14. An upper portion of tray 30 is shaped as a funnel 34 so as to ensure that stormwater passing through the storm grate 12 will be directed into the tray 30. In order to avoid having standing water within the tray 30 for extended periods of time, a number of drain openings 31 may be provided in a lower surface of the tray 30 to provide slow drainage. The drain openings 31 may be covered by a spongelike material to ensure that only a very slow flow of liquid is permitted to pass therethrough.

As may be seen in FIG. 1, a pair of openings 32 are defined in oppositely facing side surfaces 26 of the receptacle 22 for permitting storm water 28 that is collected in a lower portion of the tray 30 to enter into the process chamber 21, where it will interact with treatment material 36 that is contained within the process chamber 21. Treatment material 36 is preferably material that is capable of absorbing heavy metals from storm water. This material is fully disclosed in U.S. patent application Ser. No. 11/242,534, filed Oct. 3, 2005, Ser. No. 10/430,170, filed May 5, 2003, and Ser. No. 11/015,233, filed Dec. 17, 2004, the disclosures of which are hereby incorporated by reference as if set forth fully herein.

Storm grates and their associated frame rims are commercially available in a wide variety of different shapes and sizes, and all different sizes and shapes are to be found under field conditions, often in unforeseen and unpredictable combinations. A contractor that has been tasked to equip stormwater grates in a large parking area with stormwater treatment systems such as those shown in FIG. 1 has in the past been required to keep in stock or to order metallic trays 30 that were specifically sized and shaped for the grates at hand. This often resulted in long delays in installation as properly sized and shaped trays 30 were often not immediately available.

A need existed for a an improved system and process for fitting stormwater grates to stormwater remediation units that provides more flexibility for manufacturers, suppliers and contractors, that is inexpensive and durable, and that is simple and easy to install.

SUMMARY OF THE INVENTION

Accordingly, it is an object of the invention to provide an improved system and process for fitting stormwater grates to stormwater remediation units that provides more flexibility for manufacturers, suppliers and contractors, that is inexpensive and durable, and that is simple and easy to install.

In order to achieve the above and other objects of the invention, a method of mounting a grate adapter unit beneath a stormwater collection grate includes steps of providing a grate adapter unit having more than one mounting flange; trimming the grate adapter unit to select one of the mounting flanges; and mounting the grate adapter unit beneath a stormwater collection grate using the selected mounting flange.

A grate adapter unit that is adapted to be mounted beneath a stormwater collection grate includes, according to a second aspect of the invention, an adapter body, the adapter body having a stormwater remediation unit mounting structure thereon for mounting a stormwater remediation unit thereto; a first mounting flange extending outwardly for a first distance; and a second mounting flange extending outwardly for a second distance that is greater than the first distance.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
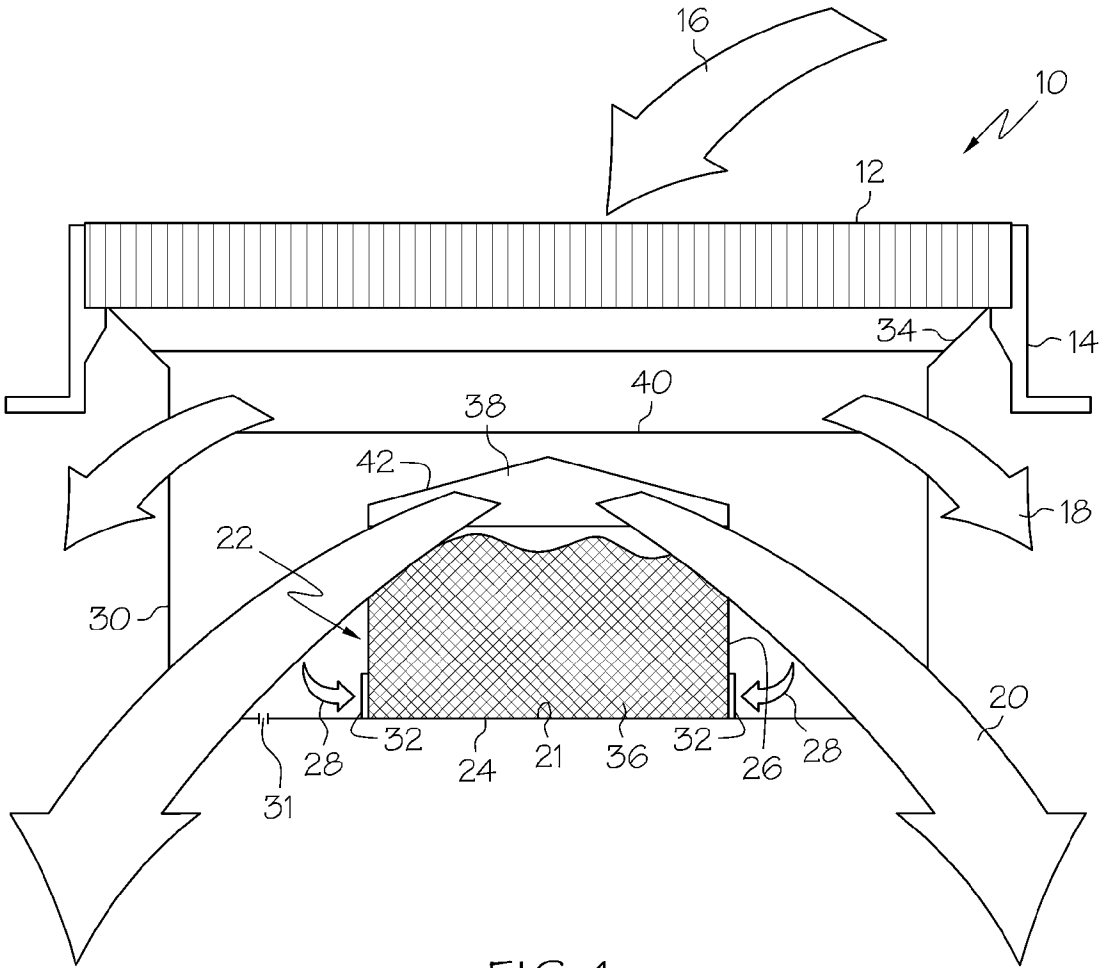
FIG. 1 (Prior Art)
FIG. 1 is a diagrammatical depiction of a conventional stormwater remediation system shown mounted beneath a stormwater grate.
Figure 2:
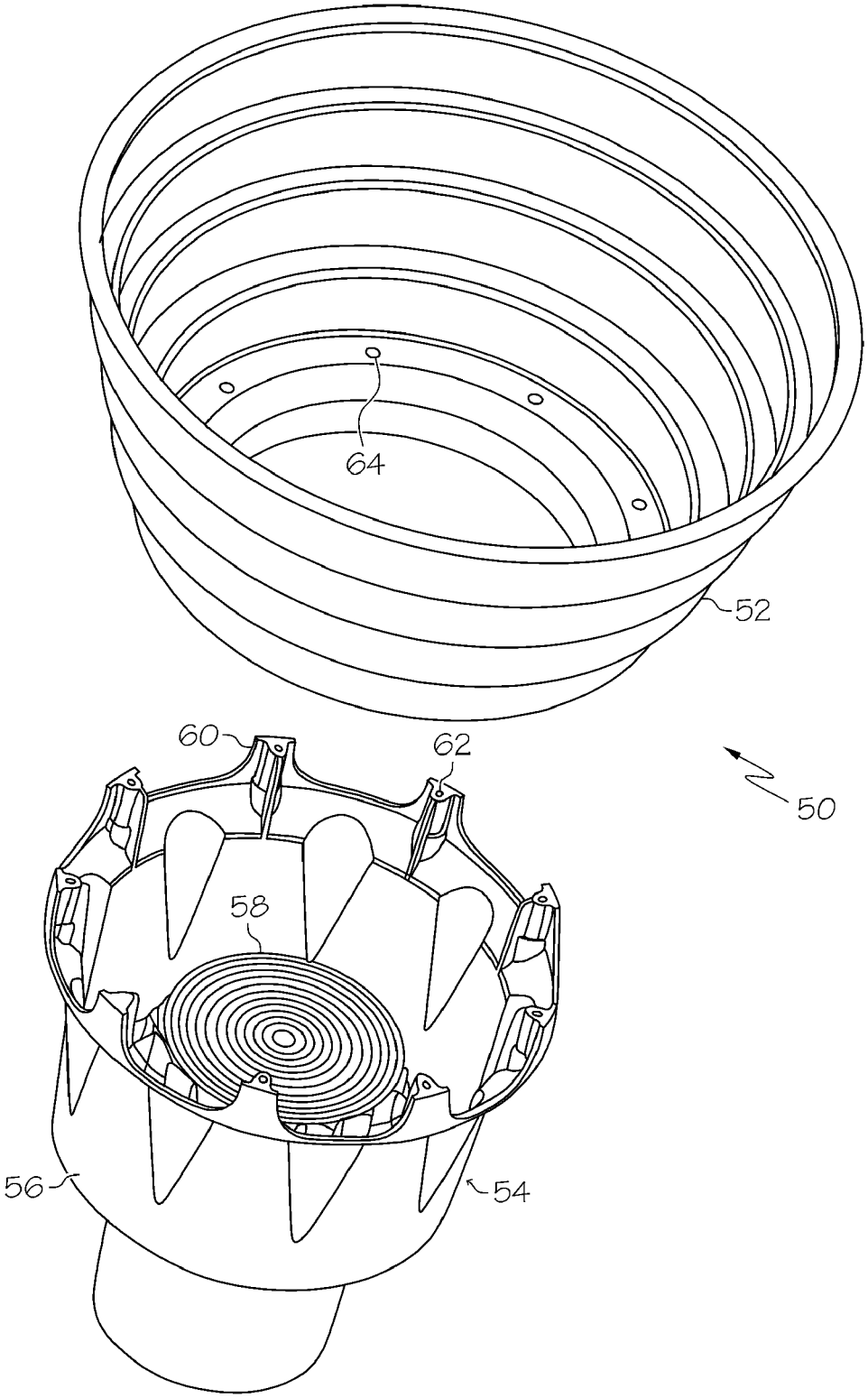
FIG. 2 is an exploded diagrammatical view depicting a stormwater remediation system that is constructed according to a preferred embodiment of the invention.

Referring now to the drawings, wherein like reference numerals designate corresponding structure throughout the views, and referring in particular to FIG. 2, a stormwater remediation system 50 that is constructed according to a first preferred embodiment of the invention includes a grate adapter unit 52 that is adapted to be mounted beneath a stormwater collection grate 12 and a stormwater remediation unit 54 that is embodied as a filter basin 56 having a filter cartridge 58 therein. Grate adapter unit is preferably fabricated out of a durable polymeric material that is preferably vacuum formed polyethylene, but that could be an alternative material such as polypropylene.

Filter cartridge 58 is preferably constructed as a modular unit that is releasably securable to the filter basin 56, and preferably includes an upper layer of geotextile fabric for filtering coarse materials from storm water that collects within the collection basin. A layer of anti-microbial polymeric material is further provided, which is preferably constructed of a material that is commercially marketed as the AEGIS shield by AEGIS Environments of Midland, Mich. The AEGIS shield is a unique chemical technology that can be applied to a material making it antimicrobially active. The AEGIS Microbe Shield technology permanently bonds (polymerizes) with the substrate and will not leach or diminish overtime. The technology relies on the coating remaining affixed to the substrate—killing microorganisms as they contact the treated surface. The AEGIS Microbe Shield is a reactive silane quaternary ammonium compound. When applied as a liquid to a host filter material the active ingredient in the AEGIS Antimicrobial forms a colorless, odorless, positively charge polymer coating which chemically bonds, virtually irremovable, to the treated surface. When a microorganism comes in contact with the treated surface, the sword punctures the cell membrane and the electrical charge shocks the cell. Since nothing is transferred to the now dead cell, the Antimicrobial doesn't lose strength the sword is ready for the next cell to contact it.

Filter cartridge 58 also further preferably includes at least one layer of geotextile oil absorbent padding.

Filter cartridge 58 further preferably includes a layer of treatment material that is specifically designed to remove hydrocarbons ranging from BTEX to crude oil, sheen, chlorinated solvents, PCBs, organic solvents, pesticides & biocides, and organically bound metals from wastewater. Preferably, this type of treatment material is that which is commercially available under the tradename MYCELX from MYCELX Technologies Corporation of Gainesville, Ga. MYCELX chemistry is infused into a filter media that has been optimized for the water stream being treated. The treated MYCELX filter media instantly bonds with the targeted pollutants on contact removing 99+% from the water in a single pass. MYCELX filter media is effective on either semi-soluble or insoluble pollutants preventing the captured contamination from separating, emulsifying, or releasing once contained.

Finally, filter cartridge 58 preferably includes a layer of zeolite that has an ion exchange capacity. Zeolite is a porous crystal material composed mainly an aluminum and silicon with other minerals such as potassium, calcium and sodium, which are used as exchangeable cations. The individual crystals bond together in long chains creating a lattice type network of interconnected cavities pores and open spaces which provide sites for cation exchange and adsorption. As a filtering media, zeolite will draw liquid runoff into its crystal structure where it is adsorbed onto the large surface areas. Suspended solids are effectively removed, and become physically entrapped or encapsulated within these cavities and pores. The zeolite effectively may function as a filter bed as well as a process material for cation exchange and adsorption. Toxic metal ions in the liquid displace the calcium, sodium or potassium cations in the passageways and become strongly bonded to the numerous exchange sites. The extreme molecular complexity also significantly reduces the external surface area, which further limits the potential mobility of the contaminants to leach back into the environment.

Each zeolite mineral has a distinct ion exchange selectivity and capacity. This process occurs when water molecules can pass through the channels and pores allowing cations present in the solution to be exchanged for cations in the structure. Several factors must be considered in this process. These include solution strength, pH, temperature and the presence of other competing cations in the solution. These factors can affect both the ion exchange selectivity and capacity of the specific zeolite mineral. Chabazite and Clinoptilolite are two of the minerals in the zeolite group that possess superior ion exchange capability. Chabazite is the preferred zeolite material for use in the preferred embodiment of the invention. However, the invention may be practiced using any treatment material, zeolite or otherwise, that is capable of absorbing heavy metals from storm water. This includes zeolites or other materials that have been chemically enhanced to increase their cation exchange capacity.

Filter basin 56 includes a plurality of mounting bosses 60 that each have a flat upper surface that is adapted to seat flush with an underside of a first mounting flange 66 on the grate adapter unit 52 and each mounting boss 60 has a threaded mounting hole 62 defined therein. Mounting holes 62 are in substantial registration with slotted mounting holes 64 that are defined in the first mounting flange 66. Mounting screws (not shown) that are passed through the respective mounting holes 64, 62 will be used to secure the grate adapter unit 52 to the stormwater remediation unit. Each mounting boss 60 defines in conjunction with adjacent mounting bosses 60 bypass openings a pair of bypass openings. During overflow conditions, oil and floatable debris that has entered the filter basin 56 will tend to remain at the surface of the water that has collected within the filter basin 56. As a flooding condition progresses, the water level within the filter basin 56 will rise, and as it rises, the downwardly depending aprons of the respective mounting bosses 60 will tend to keep such materials centered within the filter basin 56 and prevented from entering the storm sewer via the bypass openings.

Figure 3:
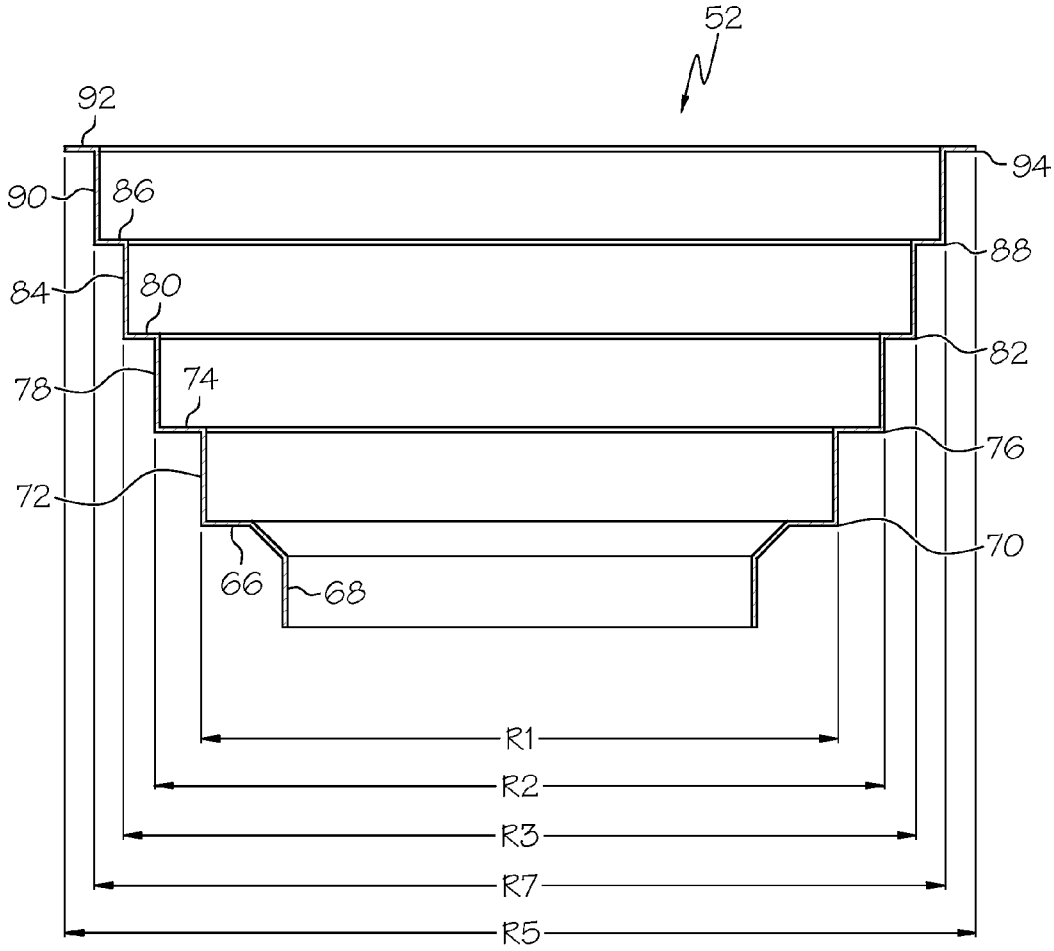
FIG. 3 is a cross sectional view depicting a component of the system that is shown in FIG. 2.

As is best shown in FIG. 3, grate adapter unit 52 has an adapter body 68 that in the preferred embodiment includes a funnel throat. Alternatively, grate adapter body could be constructed as a simple cover for covering the grate. Grate adapter body 52 is preferably shaped so that the first mounting flange 66 is substantially circular in profile and has an outer radius R1 that is preferably within a range of about 20 to about 21 inches. Most preferably the outer radius R1 of the first mounting flange 66 is approximately 20.8 inches. At the outermost edge 70 of the first mounting flange 66 the grate adapter unit steps upwardly with a cylindrical riser 72, which intersects at its uppermost end an inner edge of a second mounting flange 74.

The second mounting flange 74 is substantially circular in profile and has an outer radius R2 that is preferably within a range of about 23 to about 24 inches. Most preferably the outer radius R1 of the first mounting flange 66 is approximately 23.8 inches. At the outermost edge 76 of the second mounting flange 74 the grate adapter unit steps upwardly with a cylindrical riser 78, which intersects at its uppermost end an inner edge of a third mounting flange 80.

The third mounting flange 80 is substantially circular in profile and has an outer radius R3 that is preferably within a range of about 25 to about 26 inches. Most preferably the outer radius R3 of the third mounting flange 80 is approximately 25.8 inches. At the outermost edge 82 of the third mounting flange 80 the grate adapter unit steps upwardly with a cylindrical riser 84, which intersects at its uppermost end an inner edge of a fourth mounting flange 86.

The fourth mounting flange 86 is substantially circular in profile and has an outer radius R4 that is preferably within a range of about 27 to about 28 inches. Most preferably the outer radius R4 of the fourth mounting flange 86 is approximately 27.8 inches. At the outermost edge. 88 of the fourth mounting flange 86 the grate adapter unit 52 steps upwardly with a cylindrical riser 90, which intersects at its uppermost end an inner edge of a fifth mounting flange 92.

The fifth mounting flange 92 is substantially circular in profile and has an outer radius R5 that is preferably within a range of about 29 to about 30 inches. Most preferably the outer radius R5 of the fifth mounting flange 92 is approximately 29.8 inches. At the outermost edge 94 of the first mounting flange 66 the grate adapter unit 52 terminates.

All of the mounting flanges 66, 74, 80, 86, 92 preferably have a wall thickness that is within a range of about 1/16 inches to about 3/16 inches.

Figure 4:
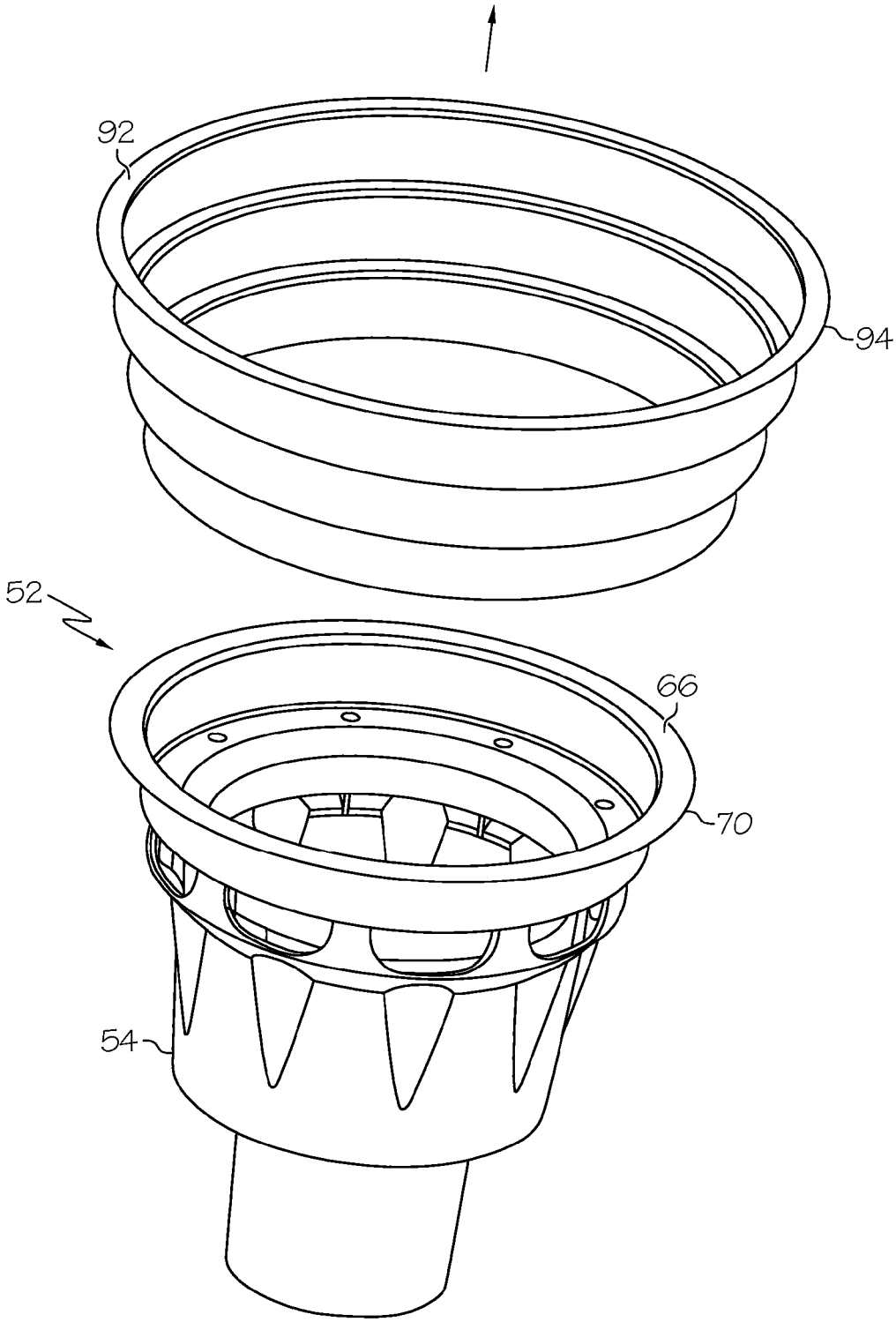
FIG. 4 is a diagrammatical view depicting a method performed according to a preferred embodiment of the invention.

In operation, a method of mounting a grate adapter unit beneath a stormwater collection grate according to a preferred embodiment of the invention will involve making the grate adapter unit 52 at a manufacturing facility as shown and described. A contractor in the field will have a need for a grate adapter unit 52 that has been customized to fit beneath a particular grate. There are a number of ways that such customization may be achieved according to the invention. First, the manufacturing facility may choose to perform the customization procedure and supply the customized grate adapter unit directly to the contractor or to the contractor via a supplier. To do this, the factory will trim the grate adapter unit 52 as depicted in FIG. 4 to cut off all of the mounting flanges and cylindrical risers that extend beyond the mounting flange that will actually be used to mount the grate adapter unit 52 beneath the stormwater collection grate 12 in the field. The trim will preferably be made at the respective outer end 70, 76, 82, 88 of the mounting flange being used. However, if the grate being fitted is of an irregular size, the trim could be made a predetermined distance radially inward from the outer end 70, 76, 82, 88 of the mounting flange being used. If the fifth mounting flange 92 is to be used, no trim process is necessary.

A second possibility is to have the trimming process performed at the facility of a supplier or wholesaler of the grate adapter unit 52. The ability to provide such a service will provide added value for the supplier's business, and reduce the amount of inventory that it is necessary for the supplier to keep in stock, thus improving cash flow for the supplier's business.

A third possibility is for the trimming process to be performed by the contractor at the contractor's home office. A fourth possibility is for the trimming process to be performed at the installation site itself. The trimming process may be performed by drilling a small hole through the extreme end of the selected end of the selected mounting flange and then using a jigsaw to cut off all of the mounting flanges and cylindrical risers that extend beyond the mounting flange that will actually be used to mount the grate adapter unit 52 beneath the stormwater collection grate 12 in the field.

Once the customized grate adapter unit is made available at the worksite, it is mounted beneath the stormwater collection grate using the selected mounting flange so that the mounting flange rests on the grate support ledge. The grate is then placed on top of the mounting flange, securing the mounting flange between the grate and the grate support ledge. A stormwater remediation unit 54 may be pre-mounted to a lower end of the grate adapter unit 52 or can be mounted to the lower end after installation.

Figure 5:
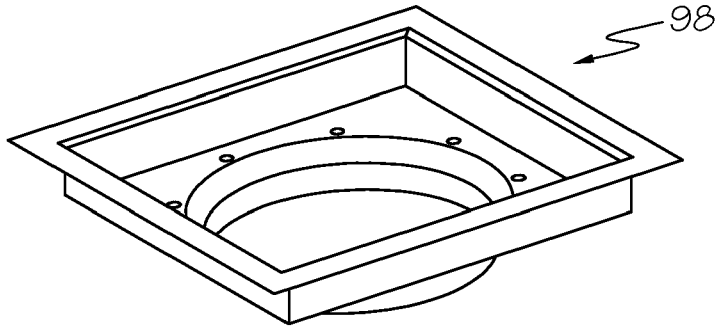
FIG. 5 is a perspective view of a component of a stormwater remediation system that is constructed according to a second embodiment of the invention.
Figure 6:
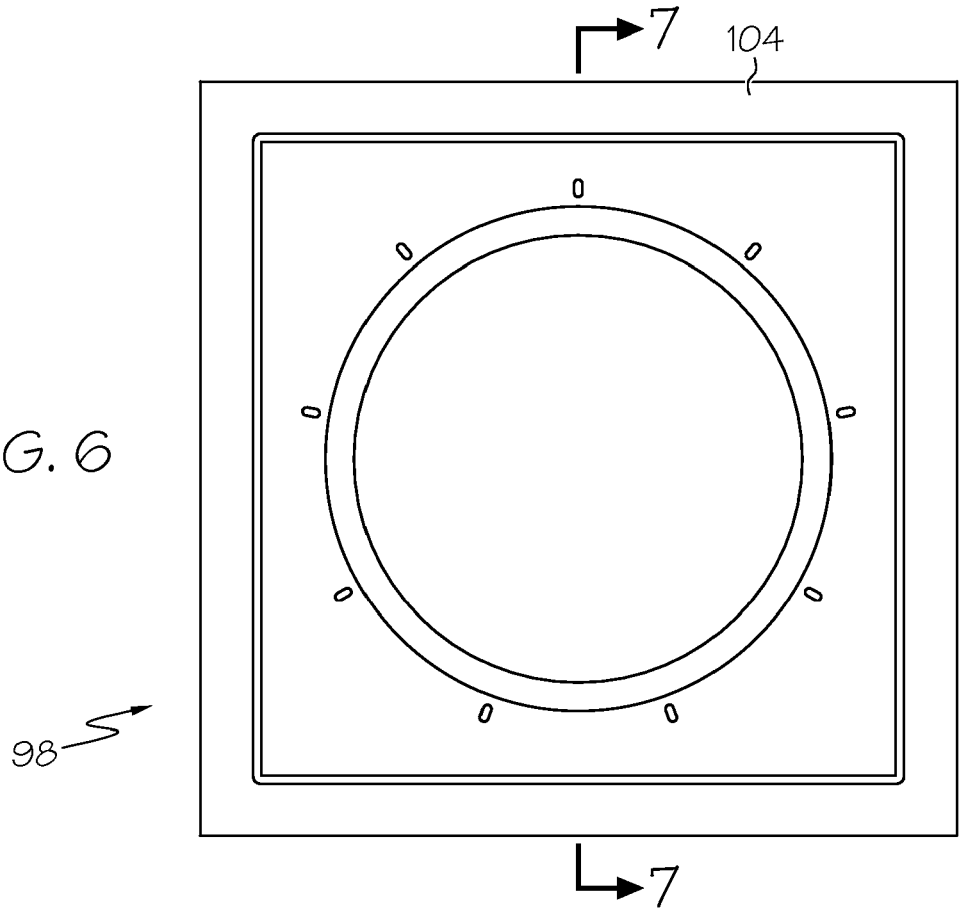
FIG. 6 is a top plan view showing the component depicted in FIG. 5.
Figure 7:
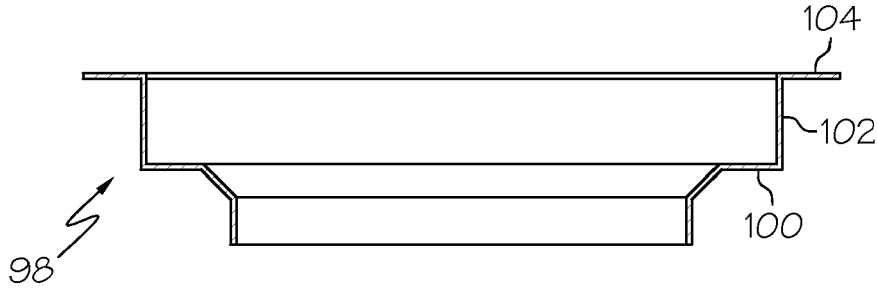
FIG. 7 is a cross sectional view depicting the component of the system that is shown in FIG. 5.

A grate adapter unit 98 that is constructed according to an alternative embodiment of the invention is depicted in FIGS. 5-7. In this embodiment of the invention, mounting flanges 100, 104 have a rectangular profile so as to be adapted to fit beneath rectangular stormwater grates. First mounting flange 100 is suited for mounting beneath a rectangular grate of a first size, while second mounting flange 104, which is vertically separated from first mounting flange 100 by a box-like riser 102, is suited for mounting beneath rectangular grates of a second, larger size. While only two mounting flanges are shown for purposes of example, it should be understood that a plurality of additional mounting flanges could be included within the spirit of the invention as disclosed in the previous embodiment.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. In a storm water collection system, the improvement comprising a modular storm water remediation system that is adapted to be mounted beneath a stormwater collection grate, comprising:

an adapter body that is adapted to be mounted beneath a stormwater collection grate, said adapter body comprising a first mounting flange extending outwardly for a first distance; and a second mounting flange extending outwardly for a second distance that is greater than said first distance, and wherein at least one of the first and second mounting flanges are formed of a thickness that is within a range of about 1/16 inch to about 3/16 inch, whereby trimming of the adapter body to fit beneath a storm water collection grate is facilitated; and a modular stormwater remediation unit removably mounted to a lower portion of the adapter body, the modular stormwater remediation unit comprising a basin and a filter cartridge.

2. A grate adapter unit according to claim 1, wherein said first mounting flange has an outer radius that is within a range of about 20 to about 21 inches.

3. A grate adapter unit according to claim 1, wherein said second mounting flange has an outer radius that is within a range of about 23 to about 24 inches.

4. A grate adapter unit according to claim 1, further comprising a third mounting flange, said third mounting flange having an outer radius that is within a range of about 25 to about 26 inches.

5. A grate adapter unit according to claim 1, further comprising a fourth mounting flange, said fourth mounting flange having an outer radius that is within a range of about 27 to about 28 inches.

6. A grate adapter unit according to claim 1, further comprising a fifth mounting flange, said fifth mounting flange having an outer radius that is within a range of about 29 to about 30 inches.

7. A grate adapter unit according to claim 1, wherein said mounting flange is substantially cylindrical.

8. A grate adapter unit according to claim 1, wherein said mounting flange is fabricated from a polymeric material.

9. A grate adapter unit according to claim 1, wherein the storm water remediation unit is removably secured to the first mounting flange.

10. A grate adapter unit according to claim 9, wherein the storm water remediation unit is removably secured to an underside of the first mounting flange.

11. A grate adapter unit according to claim 10, wherein the first mounting flange has at least one mounting hole defined therein, and wherein the storm water remediation unit includes a mounting hole that is in registration with the mounting hole in the first mounting flange.

12. A grate adapter unit according to claim 1, wherein the filter cartridge is releasably securable to the basin.

13. A grate adapter unit according to claim 1, further comprising a riser portion between the first mounting flange and the second mounting flange, the riser portion being unitary with the first mounting flange and the second mounting flange and having no other structure attached thereto.

14. A grate adapter unit according to claim 13, further comprising a third mounting flange and a second riser portion that is unitary with the second mounting flange and the third mounting flange, the second riser portion having no other structure attached thereto.

15. A grate adapter unit according to claim 14, further comprising a fourth mounting flange and a third riser portion that is unitary with the third mounting flange and the fourth mounting flange, the third riser portion having no other structure attached thereto.

16. A grate adapter unit according to claim 15, further comprising a fifth mounting flange and a fourth riser portion that is unitary with the fourth mounting flange and the fifth mounting flange, the fourth riser portion having no other structure attached thereto.

17. A grate adapter unit according to claim 16, wherein the storm water remediation unit is removably secured to the first mounting flange.

18. A grate adapter unit according to claim 17, wherein the storm water remediation unit is removably secured to an underside of the first mounting flange.

19. A grate adapter unit according to claim 16, wherein the first mounting flange has at least one mounting hole defined therein, and wherein the storm water remediation unit includes a mounting hole that is in registration with the mounting hole in the first mounting flange.

20. A grate adapter unit according to claim 16, wherein the filter cartridge is releasably securable to the basin.

* * * * *